US006571408B1

(12) United States Patent
Wang

(10) Patent No.: US 6,571,408 B1
(45) Date of Patent: Jun. 3, 2003

(54) OSCILLATORY DEVICE FOR A COLLAPSIBLE PLAYPEN

(76) Inventor: Kun Wang, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 10/047,408

(22) Filed: Jan. 16, 2002

(51) Int. Cl.[7] ..... A47C 7/00

(52) U.S. Cl. ..... 5/99.1; 5/93.1; 5/108; 5/105

(58) Field of Search ..... 5/93.1, 98.1, 99.1, 5/105, 108

(56) References Cited

U.S. PATENT DOCUMENTS 5,956,786 A * 9/1999 Huang ..... 5/105
6,026,524 A * 2/2000 Barger ..... 5/93.1
6,158,067 A * 12/2000 Cheng ..... 5/106
6,341,394 B1 * 1/2002 Wang ..... 5/105
6,349,434 B1 * 2/2002 Zhuang ..... 5/99.1
6,438,773 B1 * 8/2002 Hsia ..... 5/99.1
6,470,515 B1 * 10/2002 Hsia ..... 5/99.1

* cited by examiner

*Primary Examiner*—Teri Pham Luu

(57) ABSTRACT

An improved oscillatory device for a collapsible playpen includes for oscillatory devices respectively engaged the receiving space of four lower corner members of a collapsible playpen. The improved oscillatory devices each has a hollow interior base seat, a pedal member, an elastic resistance member and a suspending member sequentially disposed into the base seat and rotatably secured by axial pins respectively, an inverse U-shaped suspending rod and a compressed spring suspending the oscillatory device into the lower corner member. Thereby tread an extension of the base seat and simultaneously lift up the playpen to lead the suspending member moving upward. The playpen is able to oscillated steadfastly.

1 Claim, 10 Drawing Sheets

(3' — 3')

(3—3)

(3'—3')

OSCILLATORY DEVICE FOR A COLLAPSIBLE PLAYPEN

BACKGROUND OF THE INVENTION

The present invention relates to playpen and more particularly to an improved oscillatory device in the lower corner members of a collapsible playpen.

A playpen is indispensable for a family to raise a baby, especially a collapsible playpen which is readily to make a compact volume to collect and keep is welcomed public. A typical collapsible playpen 10 (as shown in FIG. 1) is combined with four upper corner members 11, four lower corner members 12, four posts 13 respectively secured to the upper and lower corner members 11 and 12, four upper transverse rods or rails 14 respectively pivoted to the upper corner members 11 and four lower transverse rods 15 respectively pivoted to the lower corner members 12. Each of the transverse rods 14 and 15 has a collapsible adapter 16 and 17 at a center. So that the playpen is collapsible. However, the lower corner members are stable this type of collapsible playpen is not oscillatory.

SUMMARY OF THE PRESENT INVENTION

The present invention has a main object to provide an improved oscillatory device for a collapsible playpen by which the collapsible playpen is readily oscillated or fixed not to oscillate.

Another object of the present invention is to provide an improved oscillatory device for a collapsible playpen which is operated by foot of the user who needs not to squate or to bow his body.

Further object of the present invention is to provide an improved oscillatory device for a collapsible playpen in which a safety device is provided to present the playpen to drop down even that the baby inadvertently touches the pedal.

Accordingly, the improved oscillatory device for a collapsible playpen comprises generally a collapsible playpen having four modified lower corner members each of which has a receiving space for receiving an improved oscillatory device. The improved oscillatory devices each has a hollow interior base, a pedal member, a resistance member and a suspending member disposed inside the base which a controlled by the pedal member to decide whether or not the improved oscillatory device is oscillated.

The present invention will become more fully understood by reference to the following detailed description thereof when read in conjunction with the attached drawings.

DETAILED DESCRIPTION OF THE PREFERRED EMBODIMENT

Figure 1:
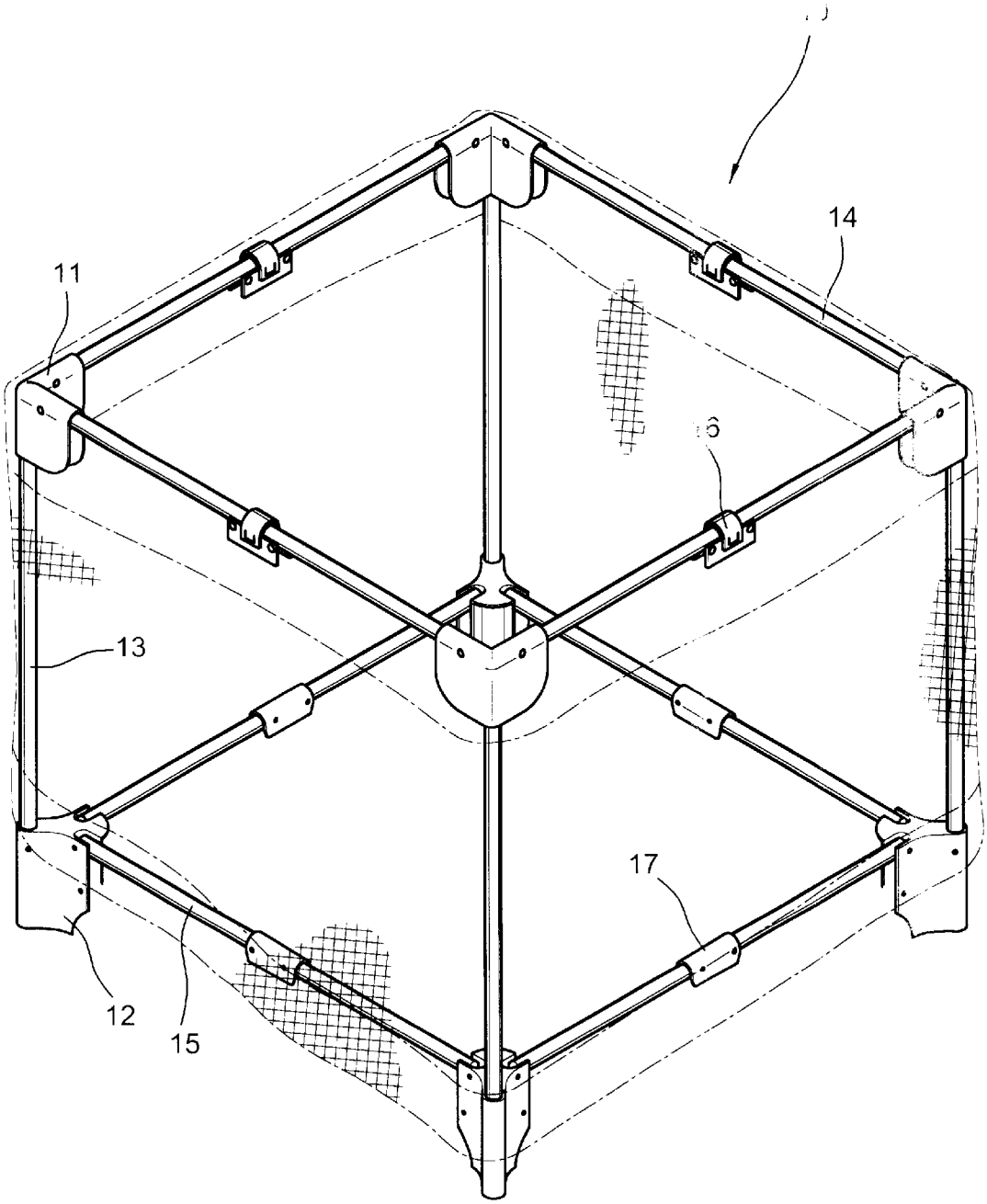
FIG. 1 Prior Art
FIG. 1 is a perspective view to show a collapsible playpen according to a prior art.
Figure 2:
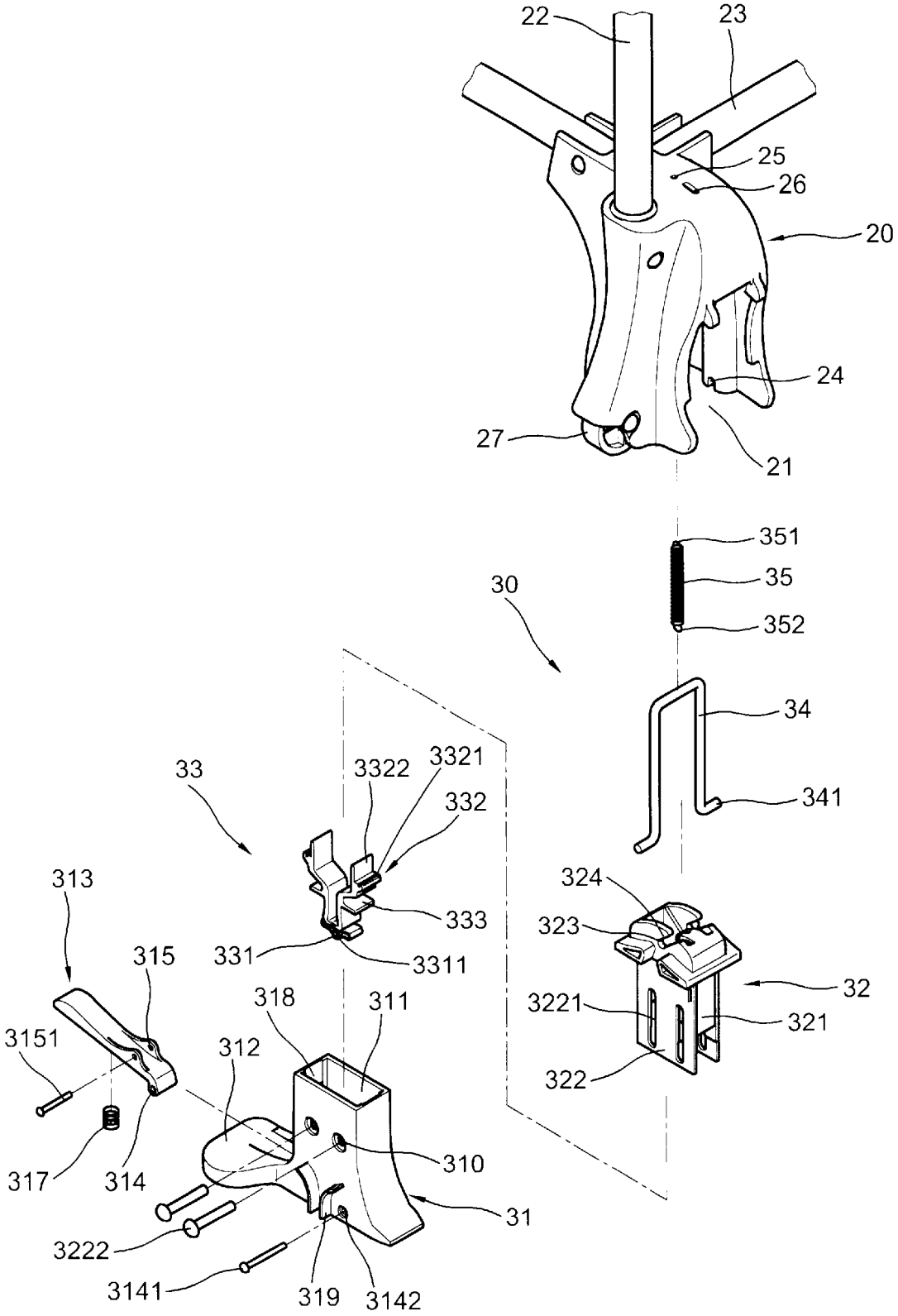
FIG. 2 is an exploded perspective view to show an improved oscillatory device according to the present invention.
Figure 3:
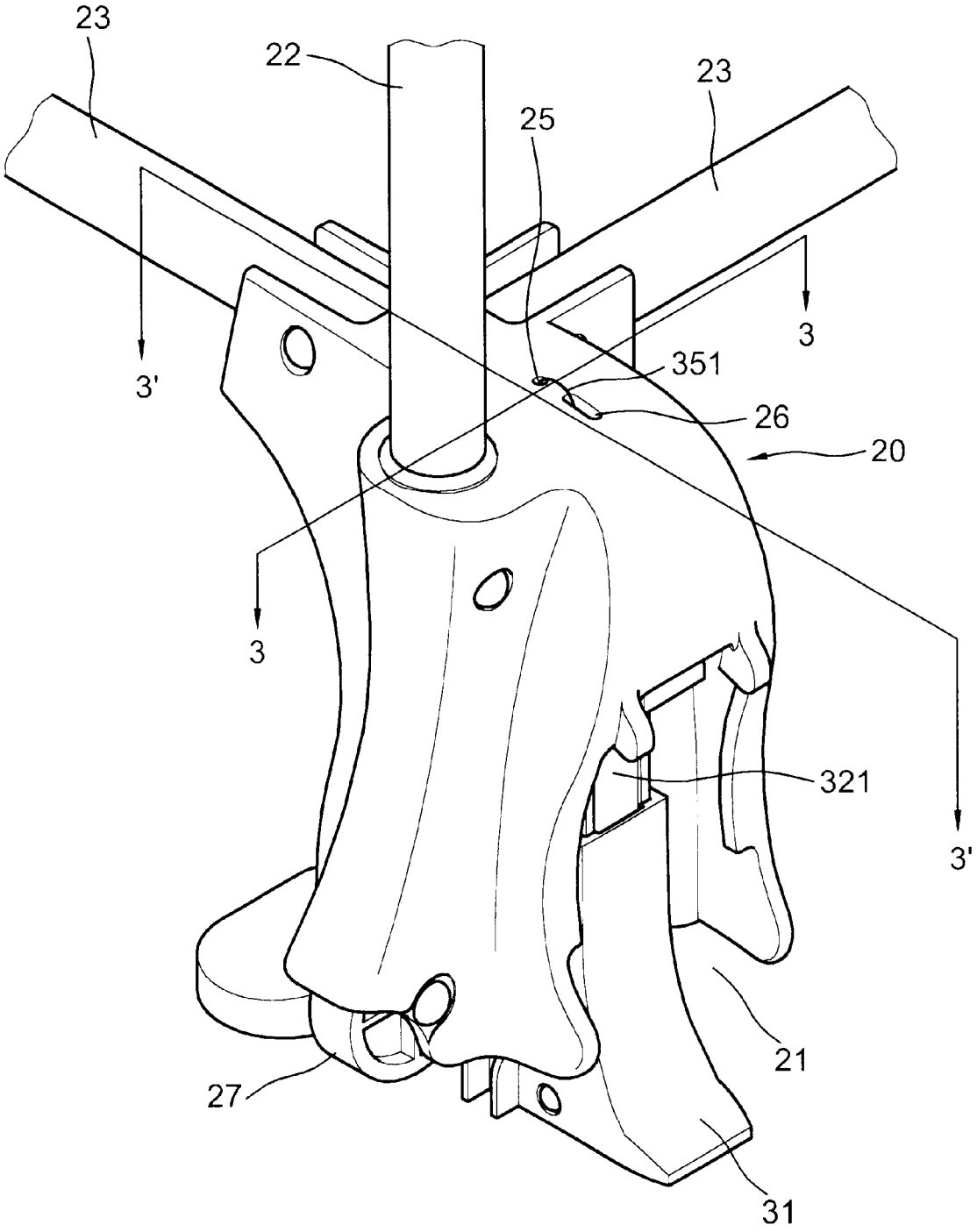
FIG. 3 is a perspective view to show the assembly of FIG. 2.
Figure 4:
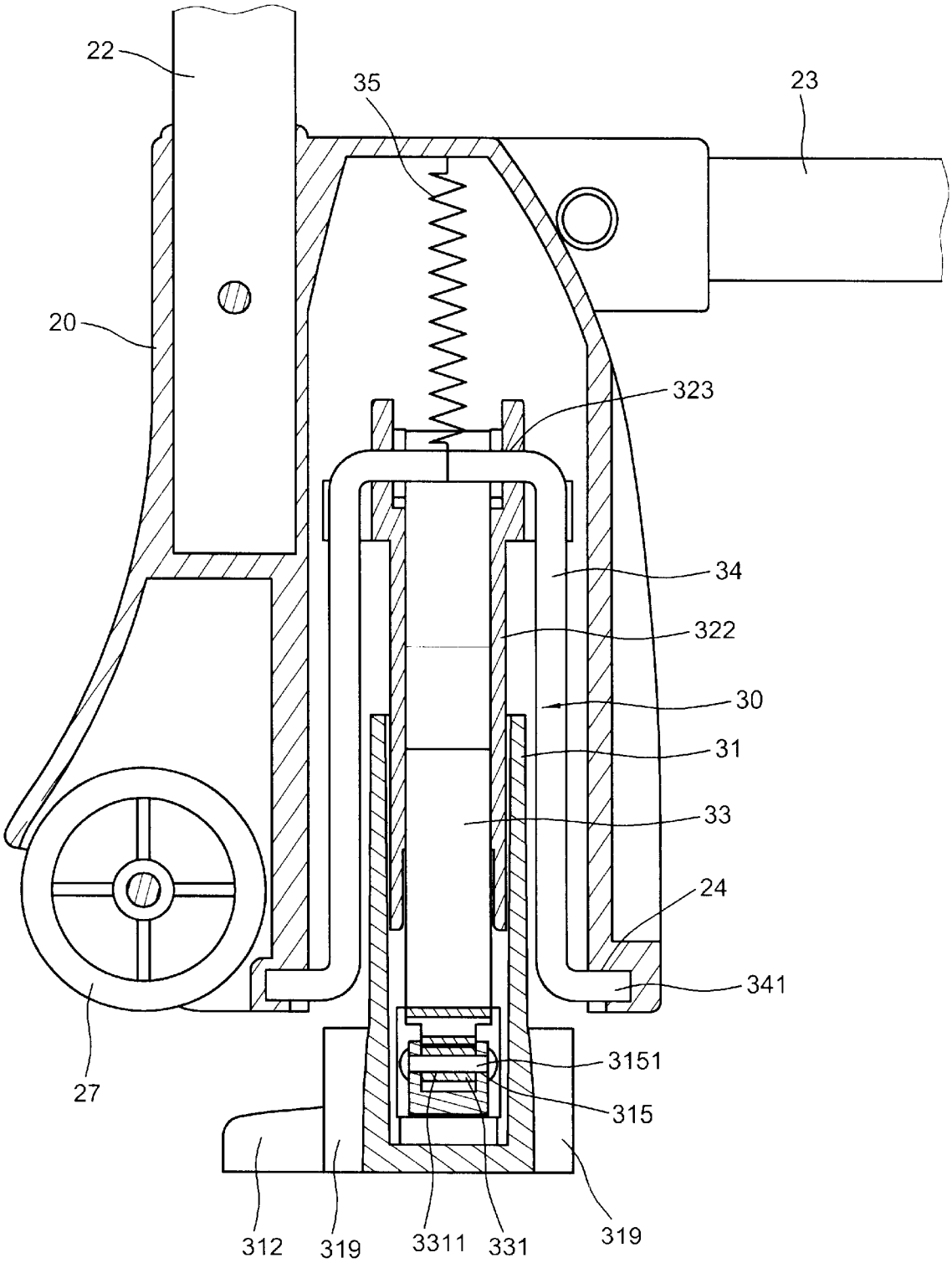
FIG. 4 is a sectional view taken along line 3—3 of FIG. 3.
Figure 5:
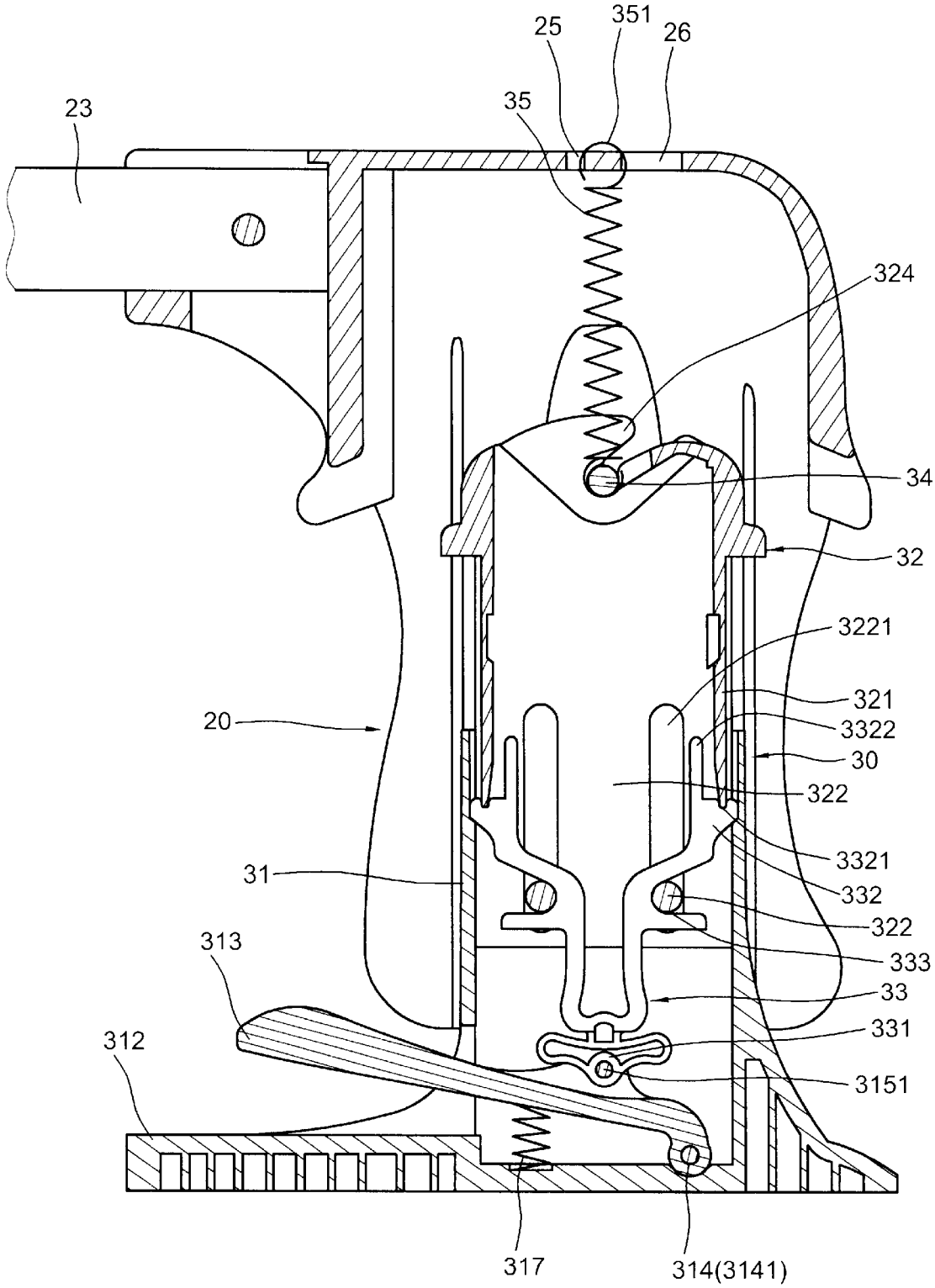
FIG. 5 is a sectional view taken along line 3'—3' of FIG. 3.

With reference to FIGS. 2 to 5 of the drawings, the improved oscillatory device for a collapsible playpen of the present invention comprises generally a collapsible playpen (as shown in FIG. 1) having four modified lower corner members 20 each of which has a receiving 21 in lower portion, a post on the top, a pair of transverse rods 23 perpendicularly pivoted to a pair of U-shaped pivots, a pair of retaining slots 24 symmetrically formed in lower end of the space 21, a circular thru hole 25 and an oblong thru hole 26 in the top thereof adjacent the post 22, and a caster 27 under a lateral side thereof.

An improved oscillatory device 30 engages into the receiving space 21 of each of the lower corner members 20. The improved oscillatory device 30 is combined with a hollow interior rectangular base seat 31, a suspending member 32, an elastic resistance member 33, an inverse U-shaped suspending rod 34 and a pedal member 313.

The hollow interior rectangular base seat has a pair of aligned thru holes 310 in front and back walls, an opening 311 in the top, an extension 312 extended outward from a lower portion of a lateral wall 318, a pair of arcuate plates 319 symmetrically disposed on a central lower portion of the front and back walls outside the base seat 31, an aligned thru hole 3142 in a lower portion of the front and back walls at the right side of the arcuate plates 319 and a slit (not shown) in the lower portion of the lateral wall 318 above the extension 312.

The pedal member 313 inserts into the base seat 31 through the slit and has a pivot hole 314 in front end engageable with the aligned thru hole 3142 pivotally secured by a retaining pin 3141, an aligned thru hole 315 in a pair of projections on the top thereof adjacent the front end and a spring 317 disposed inside the base seat 31 under the pedal member 313 for keeping the pedal member 313 to raise upward. The pedal member 313 has its rear end exposed out of the base seat 31.

The elastic resistance member 33 disposes into the base seat 31 above the pedal member 313 and has a pivoting means 331 on lower end including a thru hole engaged with the aligned thru hole 315 of the pedal member 313 and pivotally secured by a retaining pin 3151, a pair of bent arms 332 symmetrically formed and parallel extending upward and each has a roughly U-shaped retaining space 333 in outer side, a retaining slot 3321 in a top and a protrudent plate 3322 projected upward from the top thereof abutting the retaining slot 3321 for preventing a pair of reduced lateral walls 321 to move inward.

The suspending member 32 disposes into the opening 311 of the base seat 31 above the elastic resistance member 33 and has a pair of reduced lateral walls 321 engageable into the retaining slots 3321 of the elastic resistance member 33, a front and back wall 322, a bevel slot 323 in the top, a pair of bevel blocks 324 above the bevel slot 323 and a pair of aligned slits 3221 spacedly and parallel formed in front and back wall 322 engageable with the aligned thru holes 310 of the base seat 31 and slidably secured by a pair of retaining pins 3222 which also engaged within the retaining space 333 of the elastic resistance member 33.

The inverse U-shaped suspending rod 34 has a transverse upper portion engaged into the bevel slot 323 of the suspending member 32 and suspended from the top of the lower corner member 20 by a compressed spring 35 which has an upper end 351 hocked the circular thru hole 25 and the oblong thru hole 26 of the lower corner member 20 and a lower end 352 hocked the center of the transverse upper portion of the inverse U-shaped suspending rod 34. The inverse U-shaped suspending rod 34 further has a pair of symmetrically formed transverse ends engaged with the positioning slots 24 of the lower corner member 20 through the gap between the pairs of the arcuate plates 319 of the base seat 31. Note that the transverse upper portion of the inverse U-shaped suspending rod 34 should never be disengaged with the bevel slot 323 because of the bevel blocks 324 and the transverse ends 341 should never be disengaged with the positioning slots 24 because of the compressed spring 35.

Figure 6:
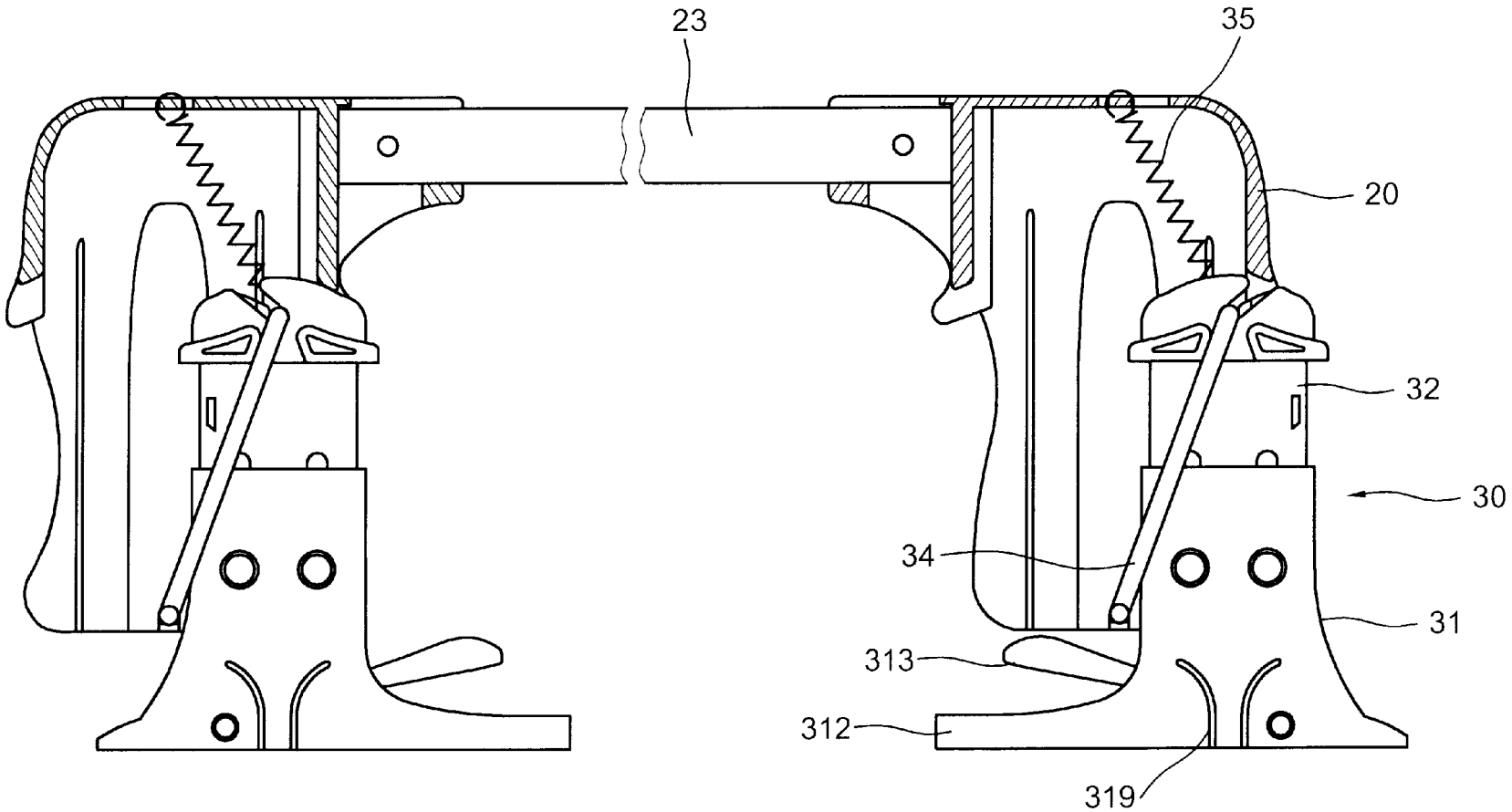
FIG. 6 is a plane view to show the improved oscillatory device within the lower corner members.
Figure 7:
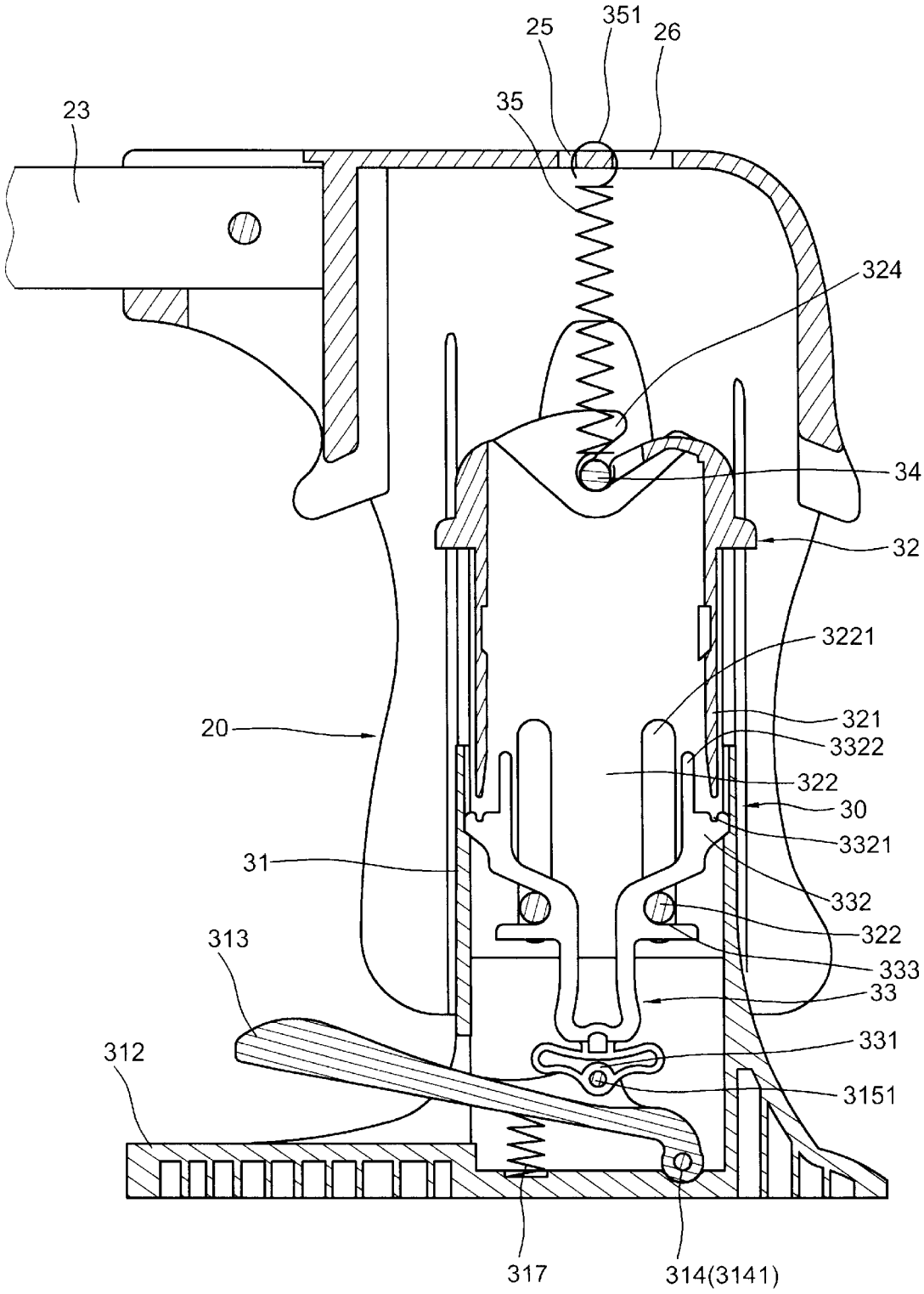
FIG. 7 is a sectional view to show that the lateral plates of the suspending member disengage with the retaining slots of the resistance member.
Figure 8:
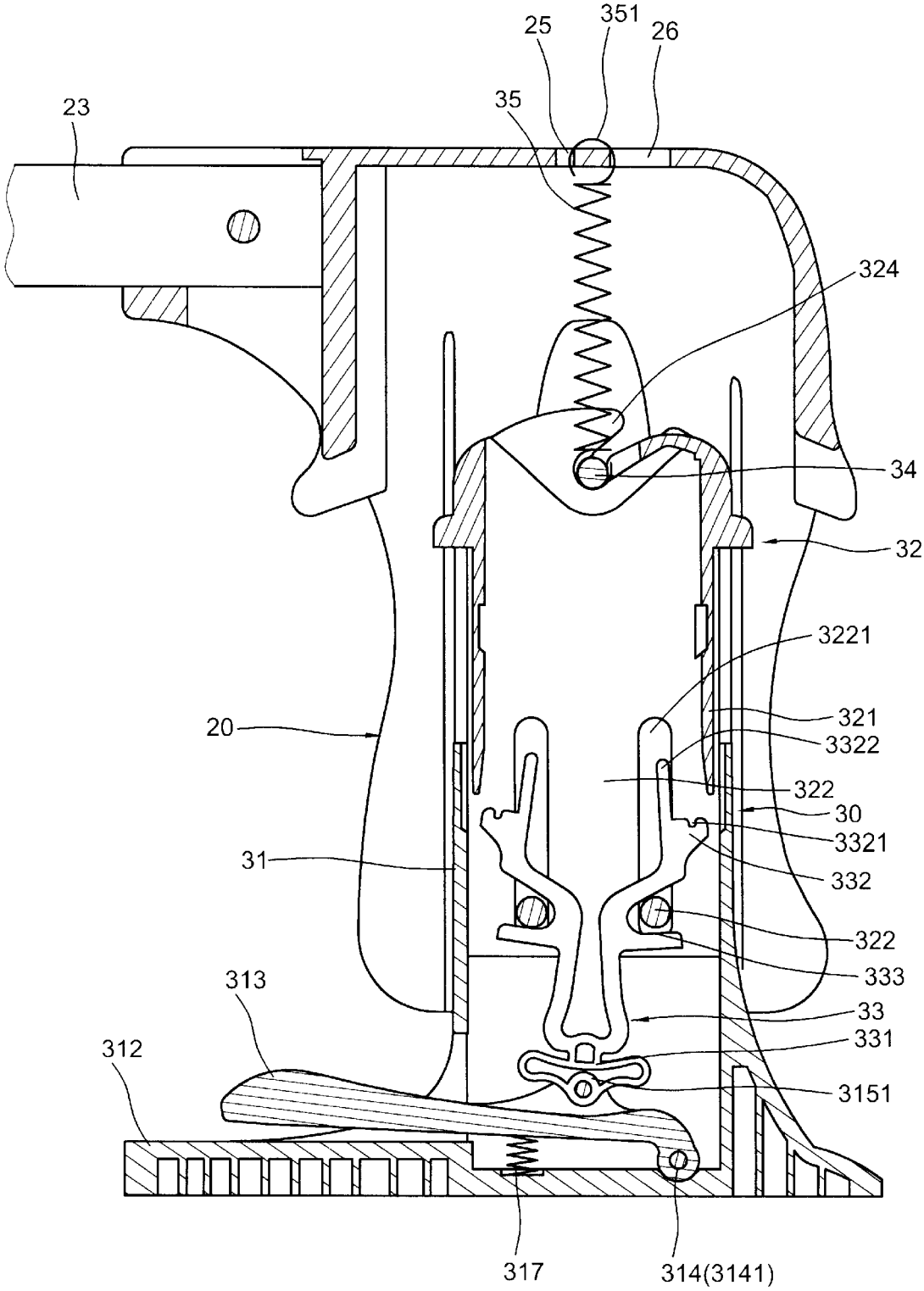
FIG. 8 is a sectional view to show that the pedal member is treaded downward.
Figure 9:
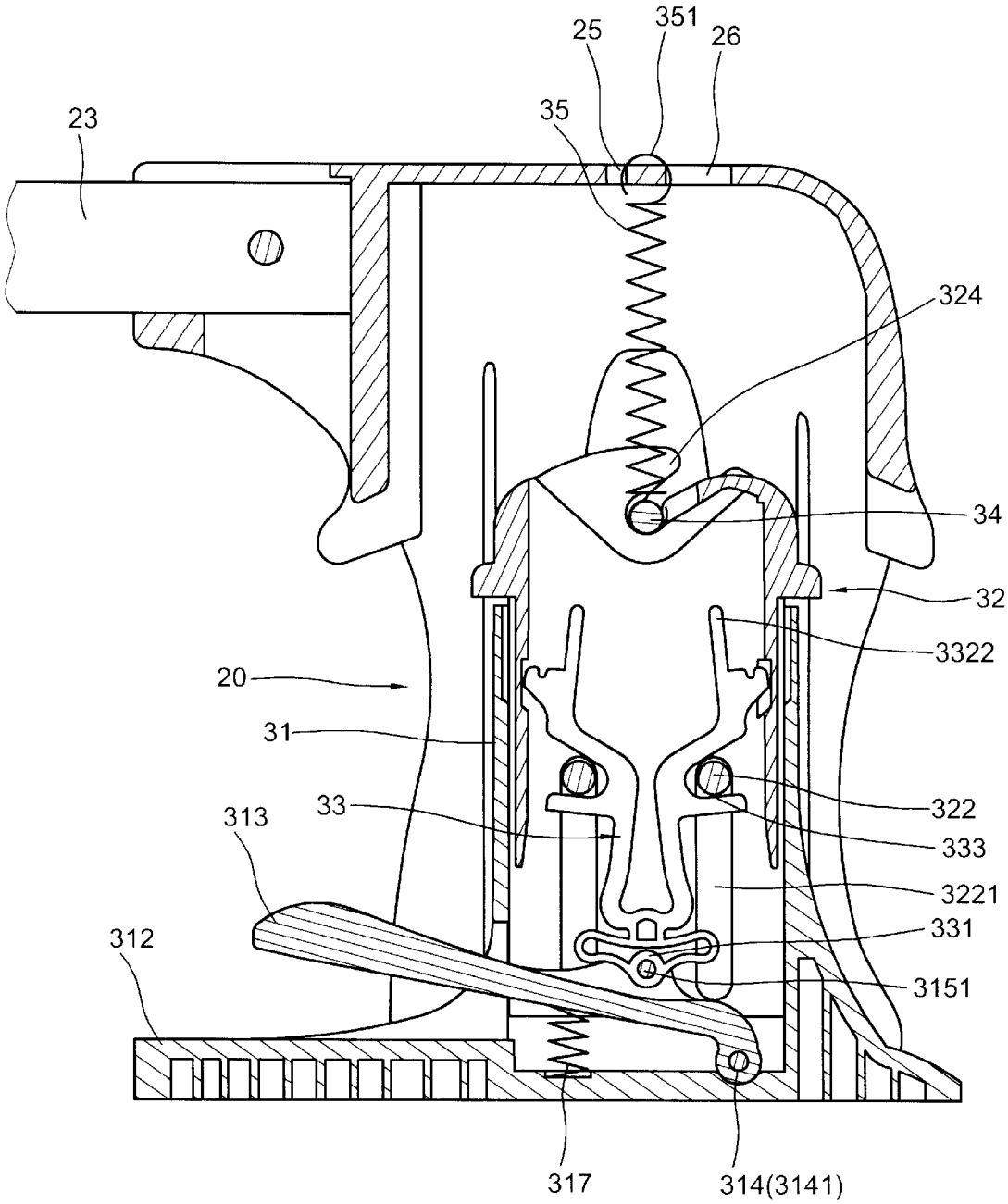
FIG. 9 is a sectional view to show that the suspending member moves downward to enable the lower corner member standing on the ground.
Figure 10:
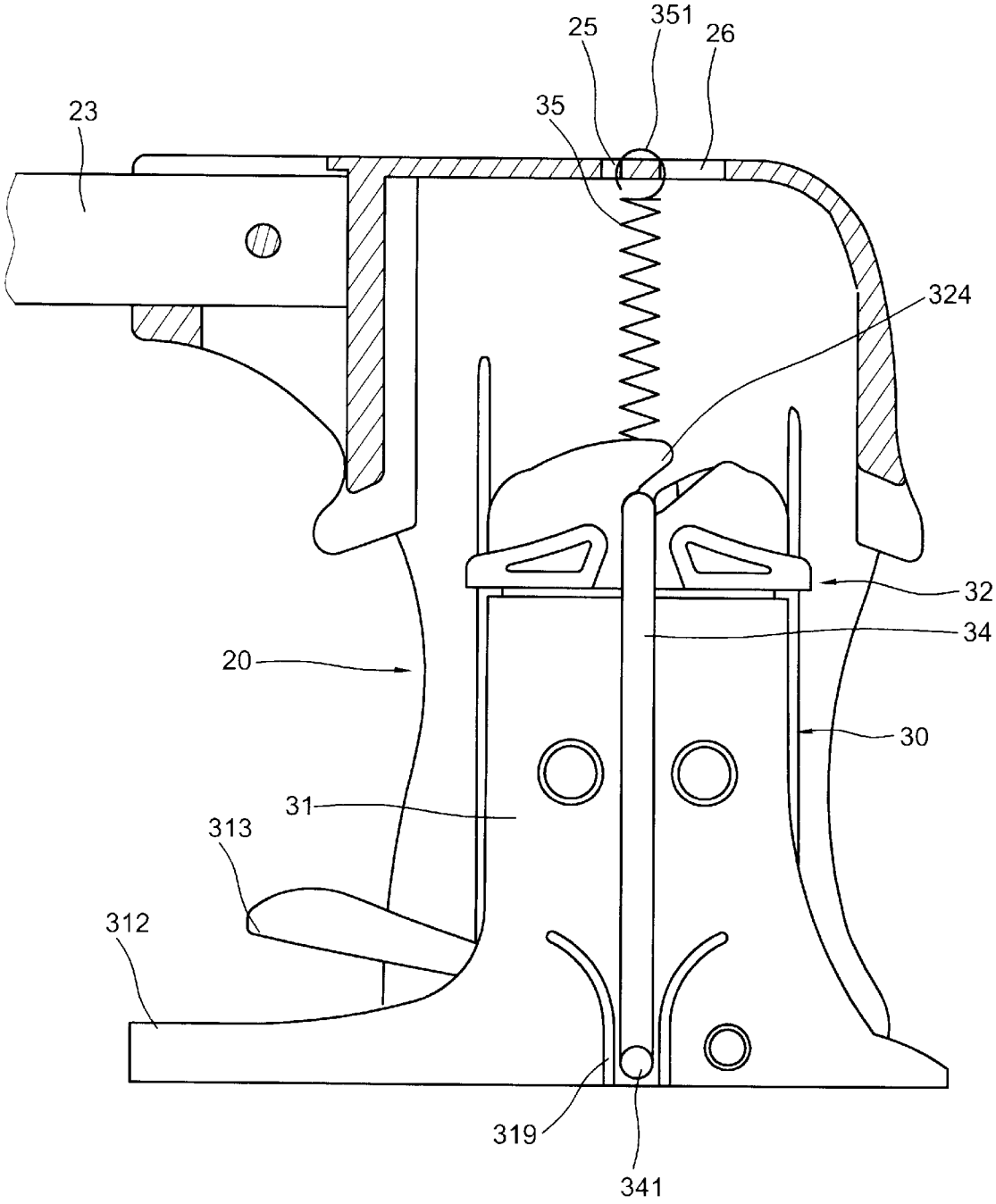
FIG. 10 is a sectional view to show that the lower portion of the suspending rod engages within the pair of arcuate plates.

Referring to FIG. 6 and FIG. 5 again, in operation first tread the extensions 312 of the base seat 31 to stabilize the lower corner members 20 and lift the playpen up (the lower corner members 20 are simultaneously moved up), the arms 332 of the elastic resistance member 33 are stretching open waiting for the downward movement of the lower corner members 20, after that the lower corner are moved down, the redused lateral walls 321 of the suspending members 32 begin to move downward to press against the arms 332 of the elastic resistance members 33 and to engaged within the positioning slots 3321 of the arms 332 which accept the weight of the suspending members 32. Meanwhile, the inverse U-shaped suspending rods are automatically lifted up-to lead the lower corner members 20 moving upward again. Therefor the playpen can be oscillated by hands so as the four lower corner members are simultaneously moving to and fro. This lime, the base seats 31 are standing on the ground to stabilize the suspending members 32 and the compressed spring 35 provide the resilient force to have the oscillation more easy.

Referring to FIGS. 7 to 10 of the drawings, tread the pedal members 313 downward, the elastic resistance members 33 are not to moved temporarily until that the playpen is lifted up to lead the inverse U-shaped suspending rod 34 and the suspending member 32 slightly moving upward to have the reduced lateral walls 321 disengaged with the positioning slots 3321 of the elastic resistance members 33. When moves the pivoting means 331 of the elastic resistance members 33 move more downward, the arms 332 of the elastic resistance members 33 begin to deform and to displace inward, release the playpen, the lower corner members 20 are automatically moving downward because of the weight of the playpen, mean while the inverse U-shaped suspending rods 34 press the suspending member more inserting into the base seat 20, release the pedal member 313 so that the lower corner members 20 are standing on the ground and the suspending rods 34 are limited between the arcuate plates 319 to have the playpen not to be oscillated. If wants the playpen to oscillate again, repeated the process as discussed the above.

The improved oscillating device of the present invention provide ready operation. The user needs not to squate or to bow his body but just treads the extensions 312 and lifts up the playpen, the process to oscillate the playpen is accomplished. Besides, the pedal member 313 has a safe function. Even if the user or a baby inadvertently touches it. The playpen is itill stable.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. An improved oscillatory device for a collapsible playpen comprising:

four lower corner members disposed on the lower portion of a collapsible playpen each having a receiving space in lower portion, a post on a top, a pair of transverse rod perpendicularly pivoted to a pair of U-shaped pivots, a pair of retaining slots symmetrically formed in lower end of the receiving space, a circular hole abutting an oblong hole in a top thereof adjacent the post and a caster under a lateral side thereof;

an improved oscillatory device disposed into the receiving space of each of the lower corner members, said improved oscillatory device each comprising:

a hollow interior rectangular base seat having a pair of first aligned thru hole spacedly formed in upper portion through front and back walls, an opening on top, an extension extending outward from a lower portion of a lateral wall, a pair of arcuate plates symmetrically formed on a central lower portion of the front and back walls outside the base seat, a second aligned thru hole in a lower portion of the front and back walls thereof on a right side of the arcuate plates and a slit in lower portion of a lateral wall above the extension;

a pedal member inserted into the base seat through the slit having a thru hole in front end engaged with the second aligned thru hole of the base seat and rotatably secured by an axial pin, a rear end extending out of the base seat and a third aligned thru hole in a pair of projections on a top thereof;

a spring disposed inside the base seat under the pedal member;

an elastic resistance member disposed into the base seat about the pedal member and having a thru hole under a pivoting means on lower portion thereof engaged with the third aligned thru hole of the pedal member and rotatably secured by an axial pin, a pair of bent arms symmetrically formed and parallel extending upward each having a U-shaped retaining space in outer side, a retaining slot in a top and a protrudent plate projected upward from a top thereof abutting the retaining slot;

a suspending member disposed into the base seat above the elastic resistance member and having a pair of reduced lateral walls engageable with the retaining slots of the elastic resistance member, a front and a back wall, a bevel slot in a top, a pair of bevel blocks above the bevel slot and a pair of aligned slits spacedly and parallel formed in the front and back wall therethrough engageable with the second aligned thru holes of the base seat and slidably secured by a pair of retaining pins which also engaged within the U-shaped retaining space of the elastic resistance member;

an inverse U-shaped suspending rod having a transverse upper portion engaged into the bevel slot of the suspending member, a pair of lateral portions engaged the arcuate plates of the base seat and a pair of transversely bent lower end engaged within the retaining slots of the lower corner member respectively;

a compressed spring suspending the suspending rod from a inner top of the lower corner member and having an upper end hocked with the circular hole and the oblong hole of the lower corner member and a lower end hocked a center of the transverse upper portion of the suspending rod;

whereby, tread the extension of the base seat and simultaneously lift up the playpen that the playpen can be able to oscillated.

* * * * *